US005860197A

United States Patent [19]

Fox

[11] Patent Number: 5,860,197

[45] Date of Patent: Jan. 19, 1999

[54] CENTERING CLAMP

[76] Inventor: Phillip S. Fox, 7140 Suntide Pl., Colorado Springs, Colo. 80919

[21] Appl. No.: 871,987

[22] Filed: May 19, 1997

[51] Int. Cl.[6] ..... A44B 21/00; B25B 3/00

[52] U.S. Cl. ..... 24/522; 24/214; 24/525; 269/87.1; 269/218; 269/249

[58] Field of Search ..... 24/522, 525, 535, 24/514, 68 D; 269/87.1, 87.2, 87.3, 89, 218, 238, 196, 234, 34, 32, 3, 6, 249

[56] References Cited

U.S. PATENT DOCUMENTS

| | | | |
|---|---|---|---|
| 0,705,932 | 7/1902 | Kennedy | 24/514 |
| 0,752,074 | 2/1904 | Jackson | 24/68 D |
| 0,996,244 | 6/1911 | Hess | 269/238 |
| 2,886,080 | 5/1959 | Rappeport | 269/87.3 |
| 2,901,012 | 8/1959 | Crispin | 269/218 |

*Primary Examiner*—Victor N. Sakran
*Attorney, Agent, or Firm*—G. F. Gallinger

[57] ABSTRACT

A centering clamp which is particularly useful for clamping work pieces in jigs is disclosed. The clamp comprises: a threaded shaft having a left hand thread on one end portion and a right hand thread on the opposite other end portion, and having a rotation means on one end portion thereof; an alignment pin; a center arm having a mounting end, a central portion having two lateral holes therethrough, one adapted to accommodate a central portion of the threaded shaft, and the other adapted to accommodate the alignment pin; a left jaw arm having a jaw end portion, a central portion having two lateral holes therethrough, one threaded to accommodate the left hand thread on the threaded shaft, and the other sized to accommodate the alignment pin; a right jaw arm having a mating jaw end portion, a central portion having two lateral holes therethrough, one threaded to accommodate the right hand thread on the threaded shaft, and the other sized to accommodate the alignment pin; and, holding means positioned on opposite sides of the center member on the threaded shaft to ensure equal extension of left and right hand threads from opposite side portions of the center arm; so that when the threaded shaft is rotated the jaw end portions move maintaining equal distances from the center arm.

17 Claims, 1 Drawing Sheet

CENTERING CLAMP

FIELD OF INVENTION

This invention relates to clamps used to hold component pieces in position on jigs for inspection, assembly, or work thereon. More particularly, this invention relates to a clamp which precisely centers any size of work piece on a center line, even as it is tightened.

BACKGROUND OF THE INVENTION

When component parts are held in a jig they frequently must be precisely positioned. Some jigs have scales along their peripheral sides to which clamps are mounted. In many cases it simplifies positioning if one need only position the clamps and then are thereby able to position all work pieces which are later held by the clamps.

On other occasions it is desirable to rotate the clamp holding the work piece in order to rotate the work piece. With most clamps it is impossible to rotate the work piece without changing its position. Even when a symmetrical work piece is rotated, it is usually necessary to reposition the clamps holding it in the jig.

OBJECTS AND STATEMENT OF INVENTION

It is an object of this invention to disclose a centering clamp. A clamp which will position various sized components about a center line and a clamp which will facilitate rotating work pieces while maintaining their centered position. It is yet a further object of this invention to disclose a versatile design for a centering clamp which may be adapted to securely hold work pieces of varying sizes, configurations, and materials. It is a final object of this invention to disclose a simple and functional design for a centering clamp which precisely positions, and may hold work pieces with a varying selected degree of force.

One aspect of this invention provides for a centering clamp comprising: a threaded shaft having a left hand thread on one end portion and a right hand thread on the opposite other end portion, and having a rotation means on one end portion thereof; an alignment pin; a center arm having a mounting end, a central portion having two lateral holes therethrough, one adapted to accommodate a central portion of the threaded shaft, and the other adapted to accommodate the alignment pin; a left jaw arm having a jaw end portion, a central portion having two lateral holes therethrough, one threaded to accommodate the left hand thread on the threaded shaft, and the other sized to accommodate the alignment pin; a right jaw arm having a mating jaw end portion, a central portion having two lateral holes therethrough, one threaded to accommodate the right hand thread on the threaded shaft, and the other sized to accommodate the alignment pin; and, holding means positioned on opposite sides of the center member on the threaded shaft to ensure equal extension of left and right hand threads from opposite side portions of the center arm; so that when the threaded shaft is rotated the jaw end portions move maintaining equal distances from the center arm.

Another aspect of this invention provides for a clamp as above wherein there are there are 2 alignment holes and 2 alignment dowels, each of the alignment holes having lengths which are at least three times the diameter of the dowels.

Various other objects, advantages and features of novelty which characterize this invention are pointed out with particularity in the claims which form part of this disclosure.

For a better understanding of the invention, its operating advantages, and the specific objects attained by its users, reference should be made to the accompanying drawings and description, in which preferred embodiments of the invention are illustrated.

FIGURES OF THE INVENTION

The invention will be better understood and objects other than those set forth will become apparent to those skilled in the art when consideration is given to the following detailed description thereof. Such description makes reference to the annexed drawings wherein: 10

Figure 1:
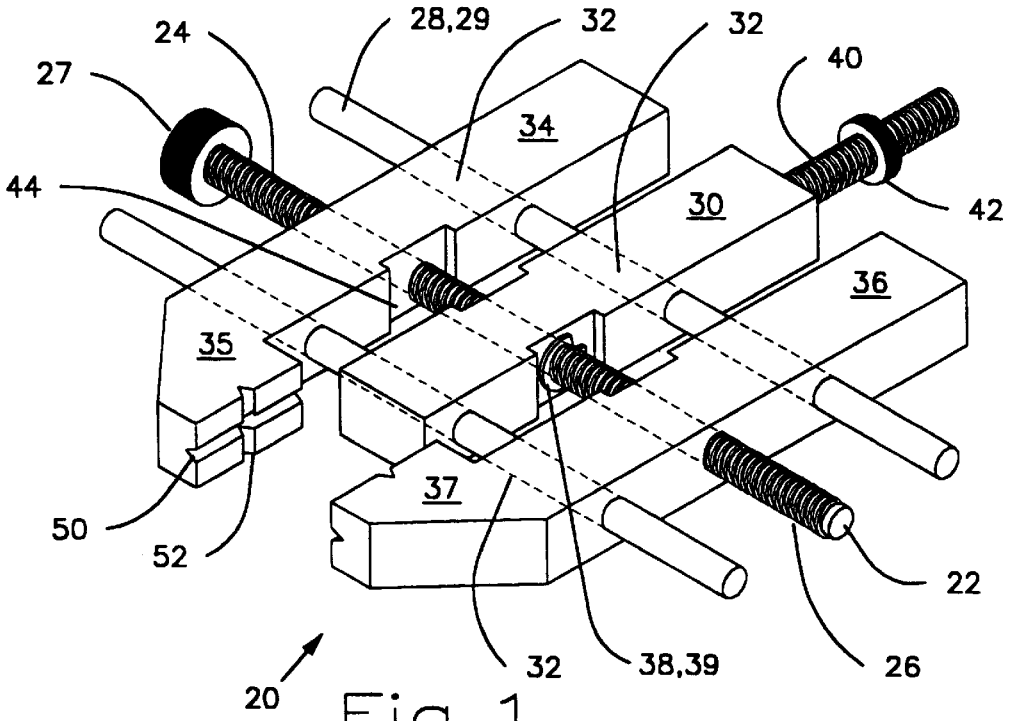
FIG. 1 is a perspective view of a centering clamp having V'd jaws.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Turning now to the drawings and more particularly to FIG. 1 we have a perspective view of a centering clamp having V'd jaws. The centering clamp 20 comprises: a threaded shaft 22 having a left hand thread 24 on one end portion and a right hand thread 26 on the opposite other end 10 portion, and having a rotation means 27 on one end portion thereof; an alignment pin 28; a center arm 30 having a mounting end, a central portion having two lateral holes 32 therethrough, one adapted to accommodate a central portion of the threaded shaft 22, and the other adapted to accommodate the alignment pin 28; a left jaw arm 34 having a jaw end portion 35, a central portion having two lateral holes 32 therethrough, one threaded to accommodate the left hand thread 24 on the threaded shaft 22, and the other sized to accommodate the alignment pin 28; a right jaw arm 36 20 having a mating jaw end portion 37, a central portion having two lateral holes 32 therethrough, one threaded to accommodate the right hand thread 26 on the threaded shaft 22, and the other sized to accommodate the alignment pin 28; and, holding means 38 are positioned on opposite sides of the center member 30 on the threaded shaft 22 to ensure equal extension of left hand thread 24 and right hand thread 36 from opposite side portions of the center arm 30; so that when the threaded shaft 22 is rotated the jaw end portions 35,37 move maintaining equal distances from the center arm 30. It has been found that a partially open C shaped spring washer 39 works well as a holding means 38.

Most preferably there are two alignment pins 28 each 10 of which are dowels 29. The dowels 29 are tightly fitted within the center arm 30 and slidably fitted within the jaw arms 34,36. It has been found that if the dowels 29 are ground within 3/10,000" of being circular, and that if the hole 32 in the jaw arms 34,36 is sized 3/10,000" larger than the dowel 29, then the arms 34,36 slide over the dowels 29 which are pressed into the center arm 30. It has also been found that if the alignment holes 32 have lengths which are at least three times the diameter of the dowels 29, then the jaw arms 34,36 slide freely thereon without binding and 20 excessive play.

A threaded bar 40 is longitudinally screwed into the mounting end of the center arm 30 opposite the jaw end portions 35,37 to hold the clamp 20. In one aspect of the invention the threaded bar 40 is screwed to a support (not shown) and locked in position with a lock nut 4. In another aspect of the invention the threaded bar 40 is adapted with a smooth end (not shown) so that it may be held in a handle member 48 with a collet or chuck (neither shown). In FIG. 1 the jaw end portions 35,37 of the clamp 20 are showing having longitudinal central Vs 50 therein to facilitate holding on center. Lateral Vs 52 on the jaw end portions 35,37 may also be provided for this same purpose.

In FIG. 1 the clamp 20 interior side portions of 10 the jaw arms 34,36 are indented 44 about the threaded shaft 22 to accommodate the spring washers 39 when the clamp 20 is fully closed.

Figure 2:
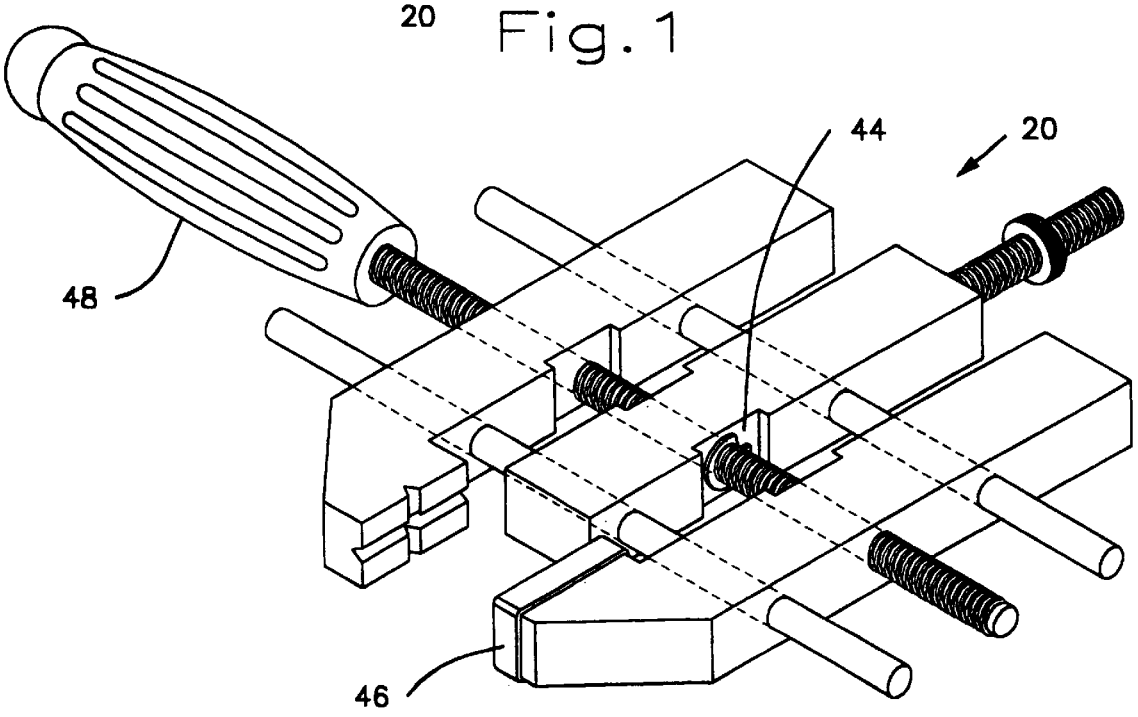
FIG. 2 is a perspective view of a centering clamp similar to that shown in FIG. 1, but having screw position maintenance means indentations on its center arm and having flat jaws adapted to carry a box cap. An elongated handle member is used for tightening the clamp.

FIG. 2 is a perspective view of a centering clamp 20 similar to that shown in FIG. 1, but having screw position maintenance means indentations 44 on its center arm 30. FIG. 2 also shows an alternative type of jaw end portions 35,37. These flat jaw end portions 35,37 may be used to carry a plastic box cap 46 which is used to clamp delicate work pieces (not shown).

FIG. 2 also shows an alternative rotation means 27 used to rotate the threaded shaft 22. In FIG. 1 the rotation means 27 shown on be threaded shaft 22 is a finger wheel 50. In FIG. 2 the rotation means 27 shown is an elongated handle member 48 which in addition to being used for tightening the clamp 20, is useful for holding the clamp when it solely supports a small work piece (not shown).

In the most preferred embodiment the arms 30,34,46 of the clamp 20 are made of aluminum and the shaft bar 40 the threaded shaft 22, and alignment pins 28 are made of stainless steel.

While the invention has been described with preferred specific embodiments thereof, it will be understood that this description is intended to illustrate and not to limit the scope of the invention. The optimal dimensional relationships for all parts of the invention are to include all variations in size, materials, shape, form, function, assembly, and operation, which are deemed readily apparent and obvious to one skilled in the art. All equivalent relationships to those illustrated in the drawings, and described in the specification, are intended to be encompassed in this invention. What is desired to be protected is defined by the following claims.

I claim:

1. A centering clamp comprising:

a threaded shaft having a left hand thread on one end portion and a right hand thread on the opposite other end portion, and having a rotation means on one end portion thereof;

a center arm having a mounting end, a central portion having two lateral holes therethrough, one adapted to accommodate a central portion of the threaded shaft, and the other adapted to accommodate the alignment pin;

a left jaw arm having a jaw end portion, a central portion having two lateral holes therethrough, one threaded to accommodate the left hand thread on the threaded shaft, and the other sized to accommodate the alignment pin;

a right jaw arm having a mating jaw end portion, a central portion having two lateral holes therethrough, one threaded to accommodate the right hand thread on the threaded shaft, and the other sized to accommodate the alignment pin; and, holding means positioned on opposite sides of the center member on the threaded shaft to ensure equal extension of left and right hand threads from opposite side portions of the center arm;

so that when the threaded shaft is rotated the jaw end portions move maintaining equal distances from the center arm.

2. A centering clamp as in claim 1 wherein the alignment pin is a dowel.

3. A centering clamp as in claim 2 wherein there are 2 alignment holes and 2 alignment dowels.

4. A clamp as in claim 3 wherein the holes have lengths which are at least two times the diameter of the dowel.

5. A clamp as in claim 4 wherein the alignment holes have lengths which are at least three times the diameter of the dowels.

6. A clamp as in claim 5 wherein the dowel is tightly fitted within the center arm and slidably fitted within the jaw arms.

7. A clamp as in claim 6 further comprising a threaded bar having a lock nut thereon and wherein the mounting end of the center arm is adapted to receive the threaded bar.

8. A clamp as in claim 7 wherein the holding means on the threaded shaft is a partially open spring washer.

9. A clamp as in claim 8 wherein the spring washer has a C shape.

10. A clamp as in claim 8 wherein opposite side portions of the center arm around the threaded shaft are indented to accommodate the spring washer when the clamp is fully closed.

11. A clamp as in claim 8 wherein interior side portions of the jaw arms are indented about the threaded shaft to accommodate the spring washers when the clamp is fully closed.

12. A clamps as in claim 8 wherein the rotation means on be threaded shaft is a finger wheel.

13. A clamp as in claim 12 wherein the rotation means on the threaded shaft is an elongated handle member.

14. A clamp as in claim 8 wherein the arms are made of aluminum; and the threaded shaft and bar, and alignment pins are made of stainless steel.

15. A clamp as in claim 8 wherein the jaw end portions have longitudinal central Vs therein to facilitate holding on center.

16. A clamp as in claim 15 wherein the jaw end portions additionally have a lateral V therein.

17. A clamp as in claim 8 further comprising a plastic box cap sized to cover the jaw end portion for delicate holding.

* * * * *